US012594486B2

(12) United States Patent
Holfels

(10) Patent No.: US 12,594,486 B2
(45) Date of Patent: Apr. 7, 2026

(54) BILLIARDS BALL RACK

(71) Applicant: 5050Design, Jasper, GA (US)

(72) Inventor: Robert Matthew Holfels, Jasper, GA (US)

( * ) Notice: Subject to any disclaimer, the term of this patent is extended or adjusted under 35 U.S.C. 154(b) by 248 days.

(21) Appl. No.: 18/332,144

(22) Filed: Jun. 9, 2023

(65) Prior Publication Data

US 2023/0310975 A1 Oct. 5, 2023

Related U.S. Application Data

(60) Provisional application No. 63/298,276, filed on Aug. 16, 2022.

(51) Int. Cl.
*A63D 15/00* (2006.01)

(52) U.S. Cl.
CPC ..... *A63D 15/005* (2013.01)

(58) Field of Classification Search
CPC ..... A63D 15/005
USPC ..... 473/40
See application file for complete search history.

(56) References Cited

U.S. PATENT DOCUMENTS

| | | | | |
|---|---|---|---|---|
| 702,108 | A * | 6/1902 | Marshall | A63D 15/00 473/40 |
| 1,089,140 | A | 3/1914 | Madigan | |
| 5,556,341 | A | 9/1996 | Bonn, Jr. | |
| 7,785,209 | B1 | 8/2010 | Targosz, Jr. et al. | |
| 8,911,299 | B1 * | 12/2014 | Day | A63D 15/005 473/40 |
| 9,440,138 | B1 | 9/2016 | Keyes et al. | |
| 12,311,252 | B1 * | 5/2025 | Harrington | A63D 15/005 473/40 |
| 2005/0009614 | A1 | 1/2005 | Knight | |

* cited by examiner

*Primary Examiner* — Mitra Aryanpour
(74) *Attorney, Agent, or Firm* — Briggs Intellectual Property Law; Jeremy A. Briggs

(57) ABSTRACT

A ball rack for positioning and arranging billiards balls is disclosed. The ball rack includes a formation-shaping frame, having a pair of frame arms. Further the formation-shaping frame is coupled to a billiards-ball door. The ball rack further includes a pair of rear portions provided on each respective frame arm. Further a pair of door supports are provided on the pair of the rear portions. Each door support extends upwardly from the pair of frame arms and is configured to receive a door shaft, a door panel coupled to the door shaft, and a biasing spring configured to move the billiards-ball door between an opened position, and a closed position about a door pivot axis. The ball rack as disclosed may further include a spherical protrusion mounted on the pair of arms. The spherical protrusion enables easy sliding of ball rack without disturbing the tightly racked balls.

16 Claims, 6 Drawing Sheets

BILLIARDS BALL RACK

The present application claims benefit to U.S. Provisional Patent Application No. 63/398,276 "Billiards Ball Rack," filed Aug. 16, 2022.

TECHNICAL FIELD

The present disclosure relates to a game of billiards, and more particularly, to a ball rack for positioning and arranging billiards balls in various configurations.

BACKGROUND

The beginning action in the game of billiards includes racking the balls on the billiards tabletop in a tightly racked configuration, namely, a triangle or diamond ball layout. When properly racked, the balls form either a triangle composed of the individual balls aligned such that they tangentially touch one another without gaps intervening any two contiguous balls. However, using conventional racks, the user must place the balls in the interior of the rack and carefully remove the rack such that the stationary balls are not disturbed, and no gaps are introduced between the balls. When a gap is formed but not noticed, during the initial breaking strike, the balls may not disperse correctly and leave many balls grouped tightly together, which makes gameplay disadvantageous and possible less enjoyable.

One conventional ball rack design includes a frame which can be closed when the latch is engaged, and the balls enclosed within it in the usual manner. A bar pushes the billiard balls inwardly to force all the balls closely up into an apex. To remove the frame, the operator will simply press downward his hand on a button, thereby withdrawing the latch and allowing the side bars to spring outwardly, thus permitting the frame to be lifted without any possibility of contacting with or disturbing the balls.

In another attempt to solve the ball racking problem, one conventional billiard rack compresses billiards balls towards the center of the rack from all sides. The billiard ball rack has a retractable actuator that activates packing bars to compress the balls and resets the packing bars to their original position after compression. The packing bars have an angled edge for seating the balls into the table surface when the retractable actuator is actuated. Additionally, a method of compacting balls by urging the balls from at least three sides to the center of a frame.

In accordance with another prior art a device for racking billiard balls includes a frame of substantially equilateral triangular shape having a forward apex and an oppositely located rear wall which pivotably supports an elongated compression plate adapted to be forced manually upon the rearward row of balls confined within the frame. The compression plate applies a downward and forward force upon the rearward row of balls, causing all the balls to be driven toward the forward apex in inter-contacting relationship. The frame is dimensioned such that, when the balls are forwardly driven, a clearance space is formed between the rearward row of balls and the back wall. The clearance space permits slight forward movement of the device during its removal from the balls.

However, using these conventional billiards racks does not adequately leave the balls undisturbed while removing the ball rack, making it easy to disturb or affect the billiards ball formation. Thus, there exists a need of a ball rack that facilitates positioning and arranging billiards balls.

It is with respect to these and other considerations that the disclosure made herein is presented.

SUMMARY

In one embodiment of the present disclosure, a ball rack configured to position and arrange billiards balls is disclosed. The ball rack may include a pair of frame arms defining two arms of a triangular structure. Further a pair of rear portions may be provided on each respective frame arm. In accordance with the implementation a pair of door supports may be provided on the pair of the rear portions. Further each door support may extend upwardly from the pair of frame arms. The door support may be configured to receive a door shaft, and further a door panel may be coupled to the door shaft. Further, a biasing spring may be configured to move the door panel between an opened position, and a closed position about a door pivot axis. In other aspects, a spherical protrusion may be mounted on the pair of arms such that the spherical protrusions are in contact with a billiards table. The spherical protrusion may enable easy sliding of the ball rack without disturbing tightly racked balls.

In another implementation of the present disclosure, a ball rack for positioning and arranging billiards balls is disclosed. The ball rack can include a formation-shaping frame, having a pair of frame arms. Further, the formation-shaping frame is coupled to a billiards-ball door, defining an interior portion. The billiards-ball door further forms at least one side of the billiards ball rack. The ball rack further comprises a pair of rear portions provided on each respective frame arm. Further a pair of door supports are provided on the pair of the rear portions. Each door support extends upwardly from the pair of frame arms and is configured to receive a door shaft, a door panel coupled to the door shaft, and a biasing spring configured to move the billiards-ball door between an opened position, and a closed position about a door pivot axis. The ball rack as disclosed may further comprise a spherical protrusion mounted on the pair of arms such that the spherical protrusions are in contact with a billiards table, further the spherical protrusion to enable easy sliding of ball rack without disturbing the tightly racked balls.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
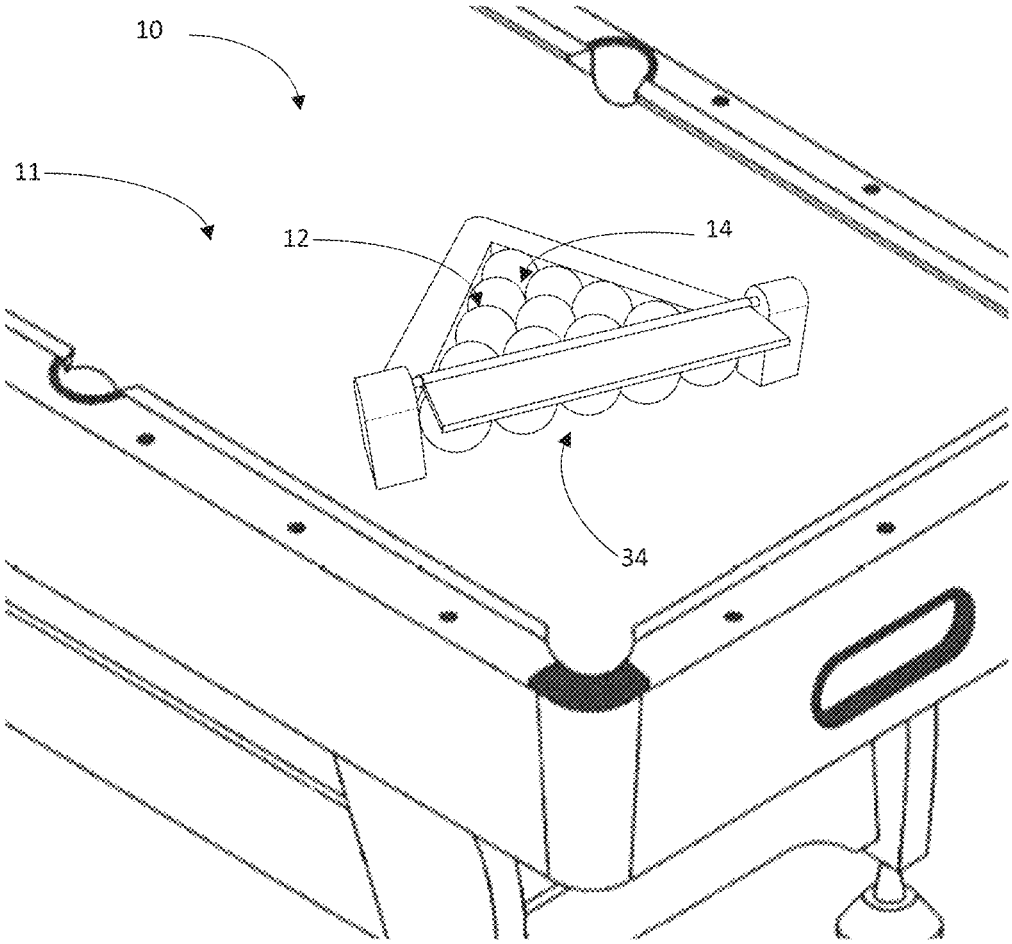
FIG. 1 illustrates a perspective view of one exemplary embodiment of a billiards ball rack in accordance with the present disclosure.

Some embodiments of the present disclosure, illustrating all its features, will now be discussed in detail. It must also be noted that as used herein and in the appended claims, the singular forms "a", "an" and "the" include plural references unless the context clearly dictates otherwise.

Unless otherwise indicated, the drawings are intended to be read (for example, cross-hatching, arrangement of parts, proportion, degree, or the like) together with the specification, and are to be considered a portion of the entire written description of this invention. As used in the following description, the terms "horizontal", "vertical", "left", "right", "up" and "down", "upper" and "lower" as well as adjectival and adverbial derivatives thereof (for example, "horizontally", "upwardly", or the like), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Overview

In an exemplary embodiment of the present disclosure a ball rack for positioning and arranging billiards balls is disclosed. The ball rack as disclosed enables conventional arrangement of the billiards balls in a triangular or diamond formation. The ball rack may include a formation-shaping frame. The formation-shaping frame may be triangular structure. The triangular structure in accordance with an exemplary aspect may be equilateral triangular structure. The triangular structure may further include a pair of frame arms. Each arm of the pair of frame arms may be configured to have same length to enables formation of an isosceles triangle. In another aspect the lengths of the pair of frame arms may not be same to enable non-conventional arrangement of the billiards balls.

Further the base of the triangular structure of the ball rack may include a billiards-ball door configured to hold a plurality of billiards balls securely and tightly in the formation. The billiards-ball door may be coupled to the formation-shaping frame to define an interior portion corresponding to the desired positioning and arranging of the plurality billiards balls. The billiards-ball door may be mounted on a pair of door supports, further the pair of door supports may be provided on a pair of rear portions. The pair of rear portions may be further provided on the pair of frame arms at a distal end from an apex formed by the triangular structure. The apex is formed at point where the pair of frame arms join with each other.

The pair of door supports may be configured to extend upwardly from the pair of frame arms. The door supports may be further configured to provide handgrips to a user to grip and maneuver the billiards ball rack along a surface on billiards table. Further the pair of door supports may be configured to receive a door shaft. The door shaft may be further coupled to a door panel. The door panel and door shaft may be further coupled with a biasing spring. The biasing spring may be further configured to move the billiards-ball door between an opened position, and a closed position about a door pivot axis.

Further the billiards-ball door may be pivoted downwardly about the door pivot axis to arrange the billiards-ball door in the closed position. The billiards-ball door may be spaced apart from the door pivot axis and pivoted upwardly about the door pivot axis to arrange the billiards-ball door in the opened position. In accordance with the exemplary embodiment the door pivot axis may be spaced from the surface by a distance greater than the height of each billiards ball.

Further in accordance with the exemplary aspect the ball rack may be movable relative to the formation-shaping frame to allow ingress and egress of the billiards balls to and from the interior portion. Further to enable easy sliding of the ball rack a spherical protrusion may be mounted on the pair of arms. The spherical protrusion may be positioned such that the spherical protrusion is in contact with a billiards table. The spherical protrusion in an aspect may be positioned at the apex, and at the rear end of the pair of arms. Further the spherical protrusion enables easy sliding of ball rack without disturbing the tightly racked balls.

The balls may be tightly racked by the biasing spring wrapped around the door shaft, and further the ends of the biasing spring engage in the formation-shaping frame and the door panel. The ball rack in accordance with the exemplary aspect further includes bearings. The bearings may be located between the ends of the door shaft and the formation-shaping frame to reduce friction therebetween.

In another aspect of present disclosure, a billiards ball rack is configured enable positioning and arranging billiards balls. The billiards balls, may be placed in an interior portion. The interior portion may be defined by a pair of arms connected at an apex. The pair of arms joined at the apex form a "V" shape as a part of a triangular structure. Each arm from the pair of the arms, may be configured to provide formation-shaping arm. The formation-shaping arm enable arranging the billiards balls in a shape defined by the formation-shaping arm. Further in accordance with the aspect, the pair of arms may include two rears end. Each arm from the pair of arms has rear end, and the rear end are positioned at a distal end from the apex.

The rear portions may further include two door support mounted on each of the rear portions. The door supports may be positioned opposite to each other and configured to form a base of the triangular structure. The base of the triangular structure may be configured to provide a billiards-ball door. The billiards-ball door may further a door panel. The door panel may be mounted on in the door supports, such that one an upper edge of the door panel is mechanically coupled with two passages provided on each of the door support. Further an axis extending between the two passages may define door pivot axis. The door pivot axis in accordance with an aspect may be parallel to the table, and further the door panel may be configured to open or close or rotate about the pivot axis.

Further in another aspect door pivot axis may be perpendicular to the table. Further to open or close or rotate along perpendicular door pivot axis the door panel may be spilt into two halves each mounted on the respective door support. Further each door panel may have additional support provided on adjacent to the rear end.

In accordance with the exemplary aspect, the passages may include biasing spring. The biasing springs may be coupled with the door panel to securely and restrictively open and close the door panel. In closed position the door panel may provide pressure to securely hold billiard balls placed in the interior portion in a tight formation. Further while removing the billiards ball rack, the door panel is opened, and the billiards ball rack is slidable in the direction towards the apex without disturbing the racked billiards balls. The billiards ball rack may further include a spherical protrusion disposed on the pair of arms.

These and other advantages of the present disclosure are provided in detail herein.

Illustrative Embodiments

The disclosure will be described more fully hereinafter with reference to the accompanying drawings, in which example embodiments of the disclosure are shown, and not intended to be limiting.

Figure 2:
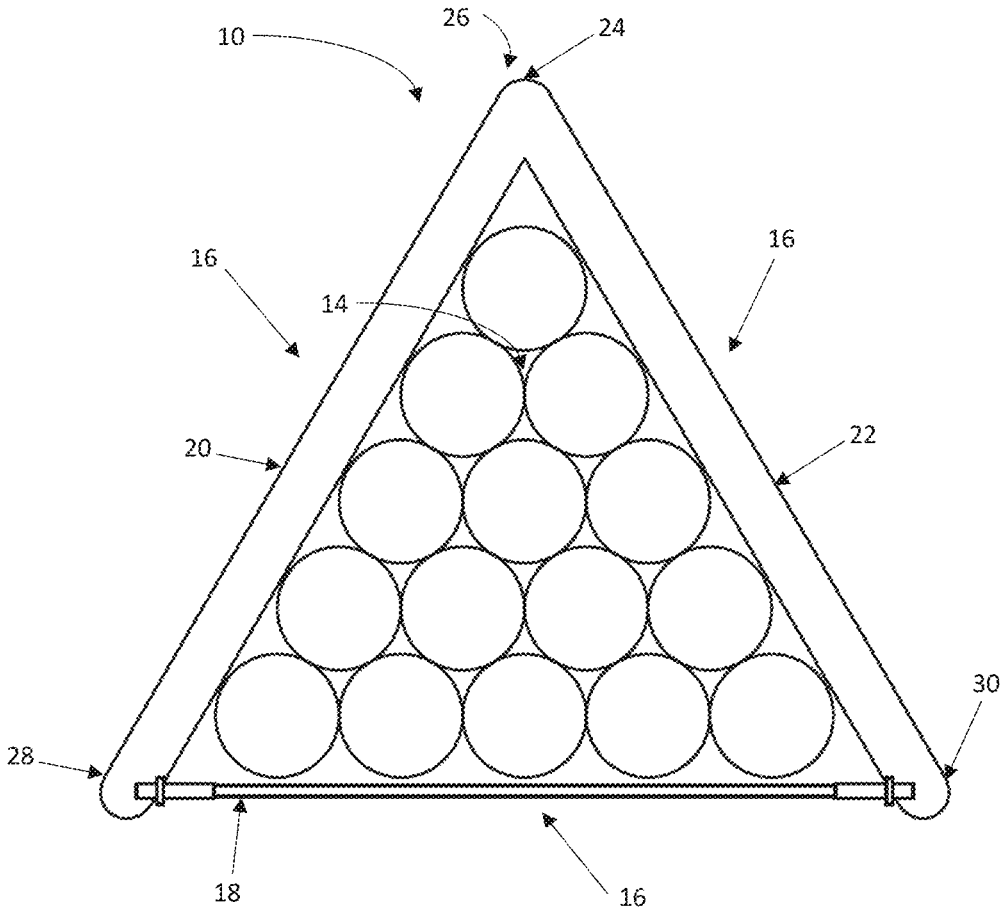
FIG. 2 illustrates a top view of the billiards ball rack from FIG. 1.

A billiards ball rack 10 in accordance with the present disclosure is shown in FIG. 1. The billiards ball rack 10 is configured to form a plurality of billiards balls 12 into an initial formation prior to the start of a cue ball game using the plurality of billiards balls 12. The billiards ball rack 10 is shaped to receive a plurality of billiards balls 12 in the illustrative embodiment and is configured to form the billiards balls 12 into the shape of an equilateral triangle within an interior portion 14 defined by the billiards ball rack 10 as shown in FIGS. 1 and 2. In other embodiments, the billiards ball rack 10 may be shaped differently to form the plurality of billiards balls 12 into a different shape, such as a diamond, for example.

To form the initial formation, the plurality of billiards balls 12 are placed in the interior portion 14 defined by the billiards ball rack 10 as shown in FIGS. 1 and 2. The billiards ball rack 10 is configured to be slidable across a surface 11, such as a felt-covered table, to force the plurality of billiards balls 12 into contact with surfaces of the billiards ball rack 10 defining the interior portion 14 and into contact with each other. The interior portion 14 is shaped so that these interactions force the billiards balls 12 into the initial formation. It should be noted that the interior portion 14 defined by the billiard ball rack 10 need not be exactly the shape of the initial formation.

The billiards ball rack 10 includes a formation-shaping frame 16 and a billiards-ball door 18 coupled to the formation-shaping frame 16 as shown in FIG. 1. The formation-shaping frame 16 and the billiards-ball door 18 define the interior portion 14. The formation-shaping frame 16 is configured to guide the plurality of billiards balls 12 into the initial formation. In some embodiments, the formation-shaping frame 16 guides the billiards balls 12 into the initial formation upon sliding movement of the billiards ball rack 10 across a surface to force the billiards balls to assume the shape defined by at least two surfaces of the formation-shaping frame 16 defining the interior portion 14. The billiards-ball door 18 forms at least one side of the billiards ball rack 10 and is movable relative to the formation-shaping frame 16 to allow ingress and egress of the billiards balls 12 to and from the interior portion 14 before and after forming the initial formation.

The formation-shaping frame 16 includes a pair of frame arms 20, 22 that connect at a apex 24 defining a forward end 26 of the billiards ball rack 10 as shown in FIG. 1. The frame arms 20, 22 each form a side of the billiards ball rack 10 to complete the equilateral triangle with the billiards-ball door 18. As the plurality of billiards balls 12 are urged forward toward the apex 24, interior surfaces of the frame arms 20, 22 shape the plurality of billiards balls 12 into the initial formation.

Figure 3:
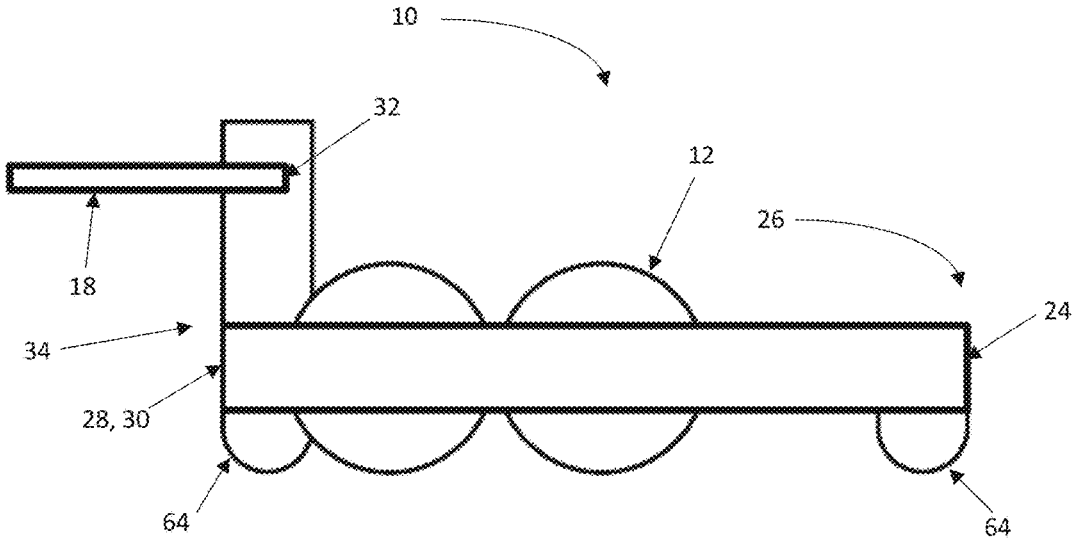
FIG. 3 illustrates a side view of the billiards ball rack from FIGS. 1 and 2 showing the billiards ball rack.

The billiards-ball door 18 is coupled to rear portions 28, 30 of each respective frame arm 20, 22 for pivotable movement relative to the formation-shaping frame 16 about a door pivot axis 32 between an opened position, as shown in FIGS. 1-3, and a closed position, as shown in FIG. 4, FIG. 5A, FIG. 5B, and FIG. 6. A lower end of the billiards-ball door 18 is spaced apart from the door pivot axis 32 and can be pivoted upwardly about the door pivot axis 32 to arrange the billiards-ball door 18 in the opened position. In the opened position, the billiards-ball door 18 is removed from a ball doorway 34 and the plurality billiards balls 12 are free to enter and exit through the ball doorway 34. The lower end of the billiards-ball door 18 can be pivoted downwardly about the door pivot axis 32 to arrange the billiards-ball door 18 in the closed position. In the closed position, the billiards-ball door 18 at least partially closes the ball doorway 34 and the plurality of billiards balls 12 are blocked from entering or exiting through the ball doorway 34. In the closed position, the lower end of the billiards-ball door 18 may be spaced apart from the surface 11 underlying the billiards ball rack 10.

Figure 6:
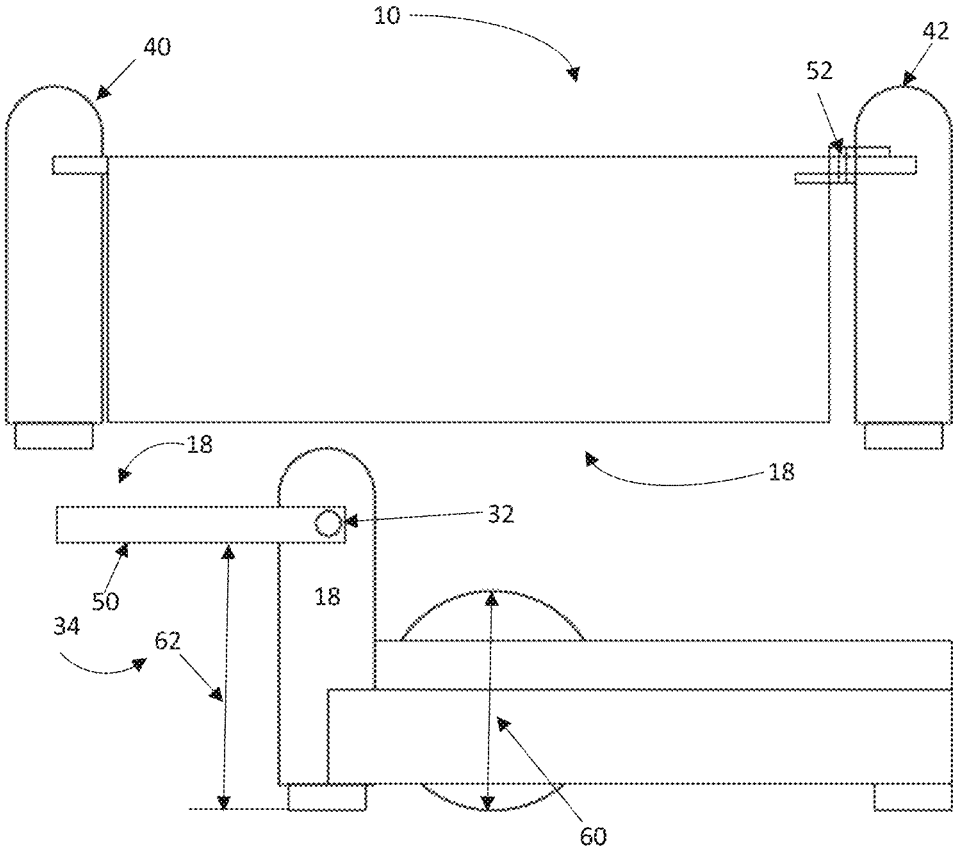
FIG. 6 illustrates a rear view and side view of another exemplary embodiment of the billiards ball rack from FIGS. 1-2.
Figure 7:
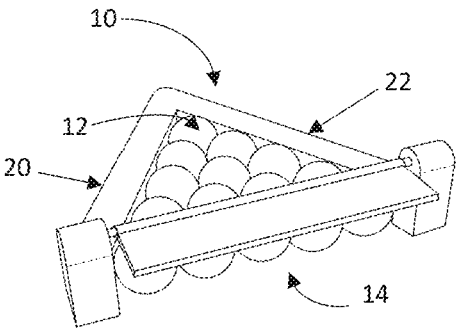
FIGS. 7-11 are a series of perspective views showing the billiards ball rack being used to form a plurality of billiards balls into an initial formation.

Each of the billiards balls 12 has a height 60 as shown in FIG. 6. The door pivot axis 32 is spaced from the surface 11 by a distance 62 that is greater than the height 60 of each billiards ball 12. In this way, each of the billiards balls 12 is able to pass beneath the billiards-ball door 18 when the billiards-ball door 18 is in the opened position.

In the illustrative embodiment, each frame arm 20, 22 of the formation-shaping frame 16 includes a formation-shaping beam 36, 38 and a door support portions 40, 42. The formation-shaping beams 36, 38 are configured to interact with the plurality of billiards balls 12 during formation of the initial formation. The door support portions 40, 42 provide the rear portions 28, 30 of the formation-shaping frame 16 and are configured to support the billiards-ball door 18. In some embodiments the door support portions 40, 42 are omitted and the billiards-ball door 18 is coupled directly to the formation-shaping beams 36, 38.

Each door support portions 40, 42 extends upwardly from the formation-shaping beams 36, 38 and is formed to include a passageway 44, 46 that receives a portion of the billiards-ball door 18 to mount the billiards-ball door 18 to the formation-shaping frame 16. The passageways 44, 46 may be a through-hole or a blind hole. The door support portions 40, 42 also provide handgrips that a user can use to grip and maneuver the billiards ball rack 10 along the surface 11.

Figure 4:
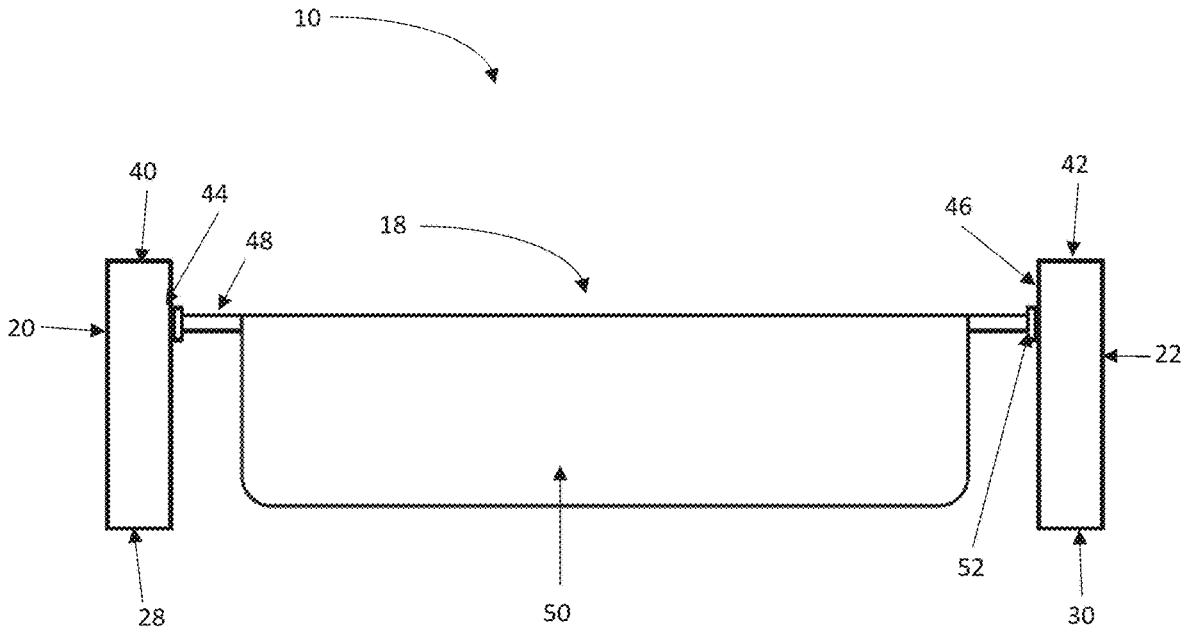
FIG. 4 illustrates a rear view of the billiards ball rack from FIGS. 1-3.

The billiards-ball door includes a door shaft 48, a door panel 50 coupled to the door shaft 48, and a biasing spring 52 as shown in FIGS. 2 and 4. Opposing ends of the door shaft 48 are received in the passageways 44, 46 formed in the formation-shaping frame 16. An upper end of the door panel 50 is coupled to the door shaft 48 for movement therewith or relative thereto. The door panel 50 extends away from the door shaft 48 to interact with the plurality of billiards balls 12 and block the billiards balls 12 from exiting the interior portion when the billiards-ball door 18 is in the closed position.

The biasing spring 52 is coupled to the formation-shaping frame 16 and at least one of the door shaft 48 and the door panel 50 and is configured to bias the door panel 50 toward the opened position. Illustratively, the biasing spring 52 may be a torsion or other type of spring that is wrapped around the door shaft 48 and has ends that engage the formation-shaping frame 16 and the door panel 50. In some embodiments, the biasing spring 52 may bias the door panel 50 toward the closed position. According to another embodiment of the present disclosure, the biasing spring 52 may alternatively bias to an open position such that a user applies manual force to close the door during a racking operation.

In some embodiments, the biasing spring 52 may be omitted. In some embodiments, each end of the door shaft 48 may receive one or more separate biasing spring(s) 52. It should be appreciated that, although referred to as a biasing spring 52, one or more springs may be utilized for biasing. Moreover, although described as a torsion spring, a spring arm or other biasing mechanism is contemplated and may be used in place of the torsion spring. In some embodiments, bearings (not shown) may be disposed between the ends of the door shaft 48 and the formation-shaping frame 16 to reduce friction between door shaft 48 and the formation-shaping frame 16.

Figure 5A:
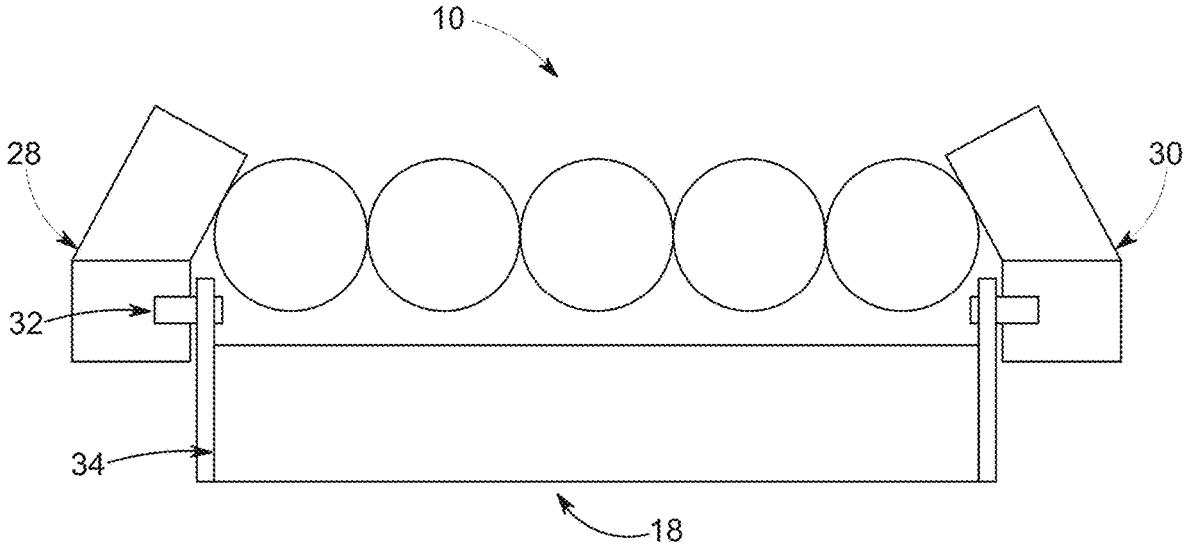
FIGS. 5A and 5B illustrate a section of top view and rear view of the billiards ball rack from FIGS. 1-2.
Figure 5B:
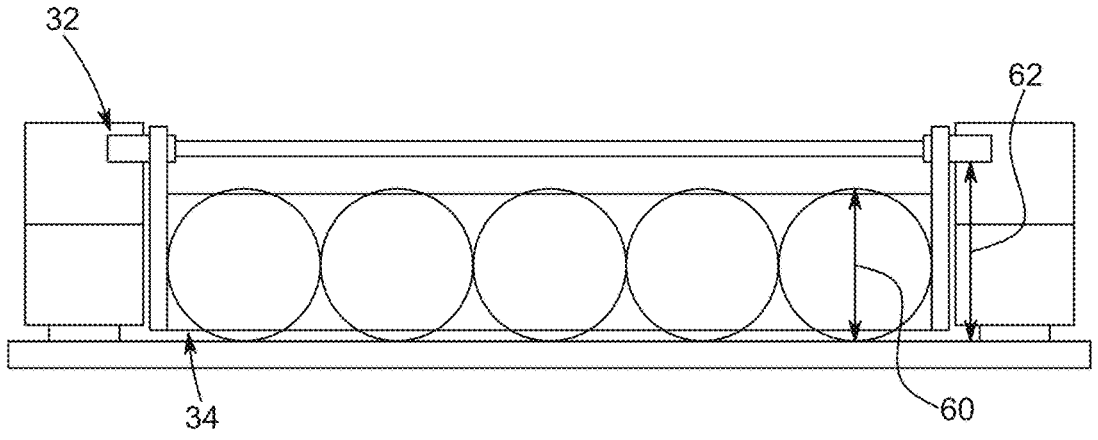

During use, each of the billiards balls 12 may be gathered into the interior portion 14 by sliding the billiards ball rack 10 across the surface while the billiards-ball door 18 is in the opened position such that the billiards balls 12 enter the interior portion 14 through the ball doorway 34. Thus, the billiards-ball door 18 allows the billiards balls 12 to be gathered without physically lifting the billiards balls 12 off the surface 11. Once the billiards balls 12 are gathered in the interior portion 14, the billiards-ball door 18 is configured to be movable from an opened position to a closed position by applying a force on the door panel 50 as shown in FIGS. 5A and 5B. The force applied on the door panel 50 can be transferred through the door panel 50 to the rearmost row of billiards balls 12. In this way, the door panel 50 applies a force on the rearmost row of the billiards balls 12 to urge all of the billiards balls forward toward the apex 24. The billiards balls 12 interact with the interior surfaces of the formatting-shaping frame 16 to establish the initial formation. Once the initial formation is established, the door panel 50 can be released and/or moved from the closed position to the opened position. Once the door panel 50 is in the opened position, the billiards ball rack 10 can be slid forward such that the billiards balls 12 exit the interior portion 14 through the ball doorway 34 while they remain in the initial formation.

In some embodiments, the billiards ball rack 10 may be referred to as an alignment tool for items used in a game. Accordingly, the present disclosure should not be limited only to billiards and can be used to form items into an initial formation for other games and/or game play items arranged in tight formation.

Figure 8:
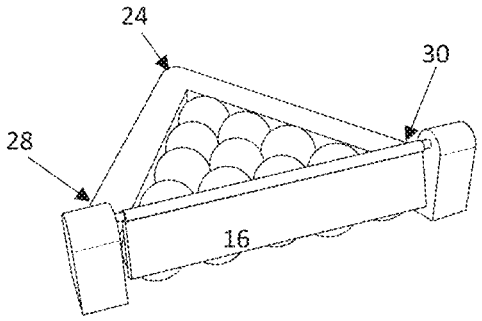
Figure 9:
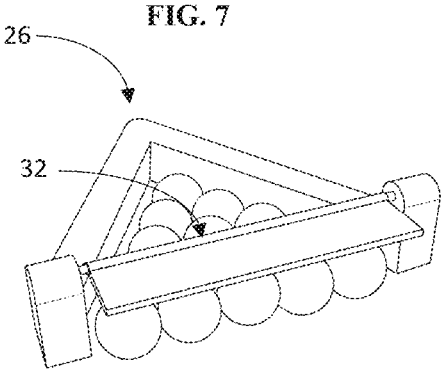
Figure 10:
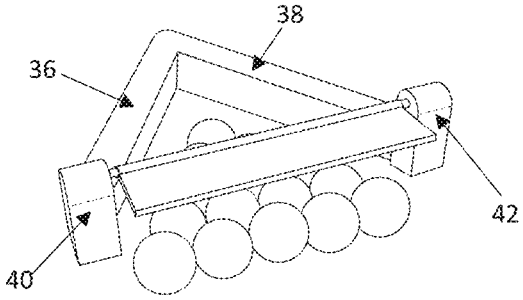

In accordance with an exemplary embodiment of the present disclosure, FIGS. 7, 8, 9, 10, and 11 illustrate positioning and arranging of billiards balls 12 using the billiard ball rack 10. With reference first to FIG. 10, the billiards balls 12 may be placed in an interior portion 14. The interior portion 14 may be defined by a pair of frame arms 20, 22 connected at an apex 24. The pair of frame arms 20, 22 joined at the apex forms a "V" shape with a forward end 26, as a part of a triangular structure. Each arm from the pair of the frame arms 20, 22, may be configured to provide formation-shaping beam 36, 38. The formation-shaping beam 36, 38 enables arranging the billiards balls 12 in a shape defined by the formation-shaping beam 36, 38. Further in accordance with this aspect, the pair of arms may include two rear portions 28, 30. Each arm from the pair of arms may include a respective rear portion, and the rear portions 28, 30 are positioned at a respective distal end from the apex 24.

The rear portions 28, 30 may further include door support portions 40, 42 mounted on a respective end of the rear portions 28, 30. The rear portions 28, 30 may be positioned opposite to each other and configured to form a base of the triangular structure. The base of the triangular structure may be configured to provide a billiards-ball door 18. The billiards-ball door 18 may further include a door panel 50. The door panel may be mounted in the door support portions 40, 42, dispose respectively proximate to the rear portions 28, 30 such that an upper edge of the door panel 50 is mechanically coupled with two passageways 44, 46 disposed on each of the door support portions 40, 42. Further, an axis extending between the two passageway 44, 46 may define door pivot axis.

Figure 11:
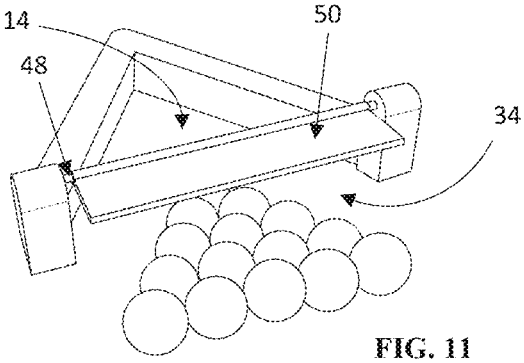

In accordance with the exemplary aspect, the passageway 44, 46 may include biasing spring 52. The biasing springs 52 may be coupled with the door panel 50 to securely and restrictively open and close the door panel 50. In closed position the door panel 50 as shown in FIG. 8 may provide pressure to securely hold billiard balls 12 placed in the interior portion 14 in a tight formation (e.g., where the plurality of billiards balls touch contiguous balls without leaving any looseness in the connection or gaps intervening the respective billiards balls). Further while removing the billiards ball rack, as shown in FIG. 9 to FIGS. 11, the door panel 50 is opened and the billiards ball rack 10 is slide in the direction towards the apex 24. To enable easy sliding of the billiards ball rack 10, the billiards ball rack 10 may further include spherical protrusion 64. The spherical protrusion 64 may be provided on the pair of frame arms 20, 22.

Further the height of ball doorway 34 may be higher than the billiards balls 12, so as to not disturb the formation while removing the billiards balls 12.

Although only a number of exemplary embodiments have been described in detail above, those skilled in the art will readily appreciate that many modifications are possible in the exemplary embodiments without materially departing from the novel teachings and advantages. Accordingly, all such modifications are intended to be included within the scope of this disclosure as defined in the following claims.

While the methods, equipment and systems have been described in connection with specific embodiments, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect.

"Optional" or "optionally" means that the subsequently described event or circumstance may or may not occur, and that the description includes instances where said event or circumstance occurs and instances where it does not.

Throughout the description and claims of this specification, the word "include" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods, equipment and systems. These and other components are disclosed herein, and it is understood that when combinations, subsets, interactions, groups, etc., of these components are disclosed that while specific reference of each various individual and collective combinations and permutation of these may not be explicitly disclosed, each is specifically contemplated and described herein, for all methods, equipment, and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

That which is claimed is:

1. A ball rack for positioning and arranging billiards balls, the ball rack comprising:
- a pair of frame arms;
- a pair of rear portions provided on each respective frame arm;
- a pair of door supports are provided on the pair of the rear portions, wherein each door support extends upwardly from the pair of frame arms and is configured to receive a door shaft, wherein:
  - each door support comprises a passageway to receive the door shaft,
  - the door shaft comprises a proximal end and a distal end,
  - the proximal end is configured to be inserted in the passageway of a first door support, of the pair of the door supports, and
  - the distal end is configured to be inserted in the passageway of a second door support, of the pair of the door supports;
- a door panel coupled to the door shaft;
- a biasing spring configured to engage with at least one of the first door support or the second door support, and at least one of the door panel or the door shaft, wherein:
  - the biasing spring is configured to move the door panel between an opened position, and a closed position about a door pivot axis, and
  - the biasing spring is configured to bias the door panel toward the opened position or the closed position to securely and restrictively open and close the door panel; and
- a spherical protrusion mounted on the pair of arms such that the spherical protrusions are in contact with a billiards table, wherein the spherical protrusion to enable easy sliding of the ball rack without disturbing tightly racked balls.

2. The ball rack as claimed in claim 1, wherein the passageway is a through-hole or a blind hole.

3. The ball rack as claimed in claim 1, wherein the pair of frame arms connect at a point defining a forward end.

4. The ball rack as claimed in claim 1, wherein a lower end of the door panel is spaced apart from the door pivot axis and pivoted upwardly about the door pivot axis to arrange the billiards-ball door in the opened position.

5. The ball rack as claimed in claim 4, wherein the lower end of the door panel is pivoted downwardly about the door pivot axis to arrange the door panel in the closed position.

6. The ball rack as claimed in claim 1, wherein the door pivot axis is spaced from the surface by a distance greater than the height of each billiards ball.

7. The ball rack as claimed in claim 1, wherein the door panel extends away from the door shaft to interact with the plurality of billiards balls and block the billiards balls from exiting the interior portion in the closed position of the door panel.

8. The ball rack as claimed in claim 1, wherein an upper end of the door panel is coupled to the door shaft.

9. A ball rack for positioning and arranging billiards balls, the ball rack comprising:
- a formation-shaping frame, having a pair of frame arms;
- a billiards-ball door coupled to the formation-shaping frame, wherein the billiards-ball door and the formation-shaping frame define an interior portion;
- wherein the billiards-ball door further forms at least one side of the billiards ball rack;
- a pair of rear portions provided on each respective frame arm;
- a pair of door supports are provided on the pair of the rear portions, wherein each door support extends upwardly from the pair of frame arms and is configured to receive a door shaft,
- wherein:
  - each door support comprises a passageway to receive the door shaft,
  - the door shaft comprises a proximal end and a distal end,
  - the proximal end is configured to be inserted in the passageway of a first door support, of the pair of the door supports, and
  - the distal end is configured to be inserted in the passageway of a second door support, of the pair of the door supports;
- a door panel coupled to the door shaft;
- a biasing spring configured to engage with at least one of the first door support or the second door support, and at least one of the door panel or the door shaft, wherein:
  - the biasing spring is configured to move the billiards-ball door between an opened position, and a closed position about a door pivot axis, and
  - the biasing spring is configured to bias the door panel toward the opened position or the closed position to securely and restrictively open and close the door panel; and
- a spherical protrusion mounted on the pair of arms such that the spherical protrusions are in contact with a billiards table, wherein the spherical protrusion to enable easy sliding of ball rack without disturbing the tightly racked balls.

10. The ball rack as claimed in claim 9, wherein the passageway is a through-hole or a blind hole provided in each of door support from the pair of door supports.

11. The ball rack as claimed in claim 9, wherein the formation-shaping frame connect at a point defining a forward end.

12. The ball rack as claimed in claim 9, wherein a lower end of the billiards-ball door is spaced apart from the door pivot axis and pivoted upwardly about the door pivot axis to arrange the billiards-ball door in the opened position.

13. The ball rack as claimed in claim 12, wherein the lower end of the billiards-ball door is pivoted downwardly about the door pivot axis to arrange the billiards-ball door in the closed position.

14. The ball rack as claimed in claim 9, wherein the door pivot axis is spaced from a surface by a distance greater than the height of each billiards ball.

15. The ball rack as claimed in claim 9, wherein the door panel extends away from the door shaft to interact with the plurality of billiards balls and block the billiards balls from exiting the interior portion.

16. The ball rack as claimed in claim 9, wherein the biasing spring is wrapped around the door shaft, and further the ends of the biasing spring engage in the door support and the door panel.

* * * * *